US008752344B1

(12) United States Patent
Morris et al.

(10) Patent No.: US 8,752,344 B1
(45) Date of Patent: Jun. 17, 2014

(54) ROOF VENT PIPE EXTENSION SYSTEM

(71) Applicants: Kevin M. Morris, Clearwater, FL (US); Richard T. Maddox, Largo, FL (US)

(72) Inventors: Kevin M. Morris, Clearwater, FL (US); Richard T. Maddox, Largo, FL (US)

( * ) Notice: Subject to any disclaimer, the term of this patent is extended or adjusted under 35 U.S.C. 154(b) by 0 days.

(21) Appl. No.: 13/665,269

(22) Filed: Oct. 31, 2012

Related U.S. Application Data

(63) Continuation-in-part of application No. 12/587,596, filed on Oct. 9, 2009, now abandoned.

(51) Int. Cl.
*E04D 13/143* (2006.01)
*E04D 13/14* (2006.01)
*E04D 13/17* (2006.01)
*F16L 21/02* (2006.01)

(52) U.S. Cl.
CPC ..... *F16L 21/022* (2013.01)
USPC ..... 52/198; 52/199; 52/219; 285/371

(58) Field of Classification Search
CPC ... E04D 13/14; E04D 13/143; E04D 13/1407; E04D 13/1476; E04D 13/17; F16L 21/02; F16L 21/022
USPC ..... 52/198, 219, 220.8, 302.1, 302.5, 90.2, 52/199; 454/44, 365, 366, 368; D8/382; 285/371
See application file for complete search history.

(56) References Cited

U.S. PATENT DOCUMENTS 354,560 A * 12/1886 Levier ..... 285/39
1,352,248 A * 9/1920 Coar ..... 285/4
RE18,119 E * 7/1931 Smith ..... 285/334.1
3,436,880 A * 4/1969 Kifer ..... 52/58
3,508,766 A * 4/1970 Berg et al. ..... 285/21.1
3,887,221 A * 6/1975 Young ..... 285/236
3,961,814 A * 6/1976 Byrne et al. ..... 285/21.1
4,013,309 A * 3/1977 Quick ..... 285/31
4,043,574 A * 8/1977 Asano ..... 285/21.1
4,043,857 A * 8/1977 Byrne et al. ..... 156/198
4,115,961 A * 9/1978 Bishop ..... 52/58
4,442,643 A * 4/1984 Stadheim ..... 52/219
4,507,842 A * 4/1985 Werner ..... 29/451
4,773,479 A * 9/1988 Guy ..... 166/242.4
4,843,794 A * 7/1989 Holtgreve ..... 52/199
4,965,971 A * 10/1990 Jean-Jacques et al. ..... 52/199
5,117,597 A * 6/1992 Feller ..... 52/199
5,349,362 A * 9/1994 Forbes et al. ..... 343/720

(Continued)

OTHER PUBLICATIONS

TUBOS® Product Sheet dated Feb. 2009, Internet Publication Date at least as early as Oct. 17, 2009, accessible via the internet archive WayBackMachine (http://web.archive.org), last visited Feb. 27, 2013, (1 page).*

(Continued)

*Primary Examiner* — Basil Katcheves
*Assistant Examiner* — Rodney Mintz

(57) ABSTRACT

An end tube has an interior and exterior diameter and a length. A central tube has an interior and an exterior diameter and a length. The length of the central tube is greater than the length of the end tube. The exterior diameter of the end tube is essentially equal to the interior diameter of the central tube. An upper portion of the end tube is inserted into and attached to a lower portion of the central tube. In this manner a lower portion of the end tube is adapted to be inserted into a vent pipe of a roof.

1 Claim, 2 Drawing Sheets

(56) References Cited

U.S. PATENT DOCUMENTS

| | | | | |
|---|---|---|---|---|
| 5,390,451 | A * | 2/1995 | Kopp et al. | 52/58 |
| 5,493,820 | A * | 2/1996 | Joseph | 52/168 |
| 5,778,611 | A * | 7/1998 | Michel | 52/198 |
| D402,533 | S * | 12/1998 | Barkan | D8/349 |
| 5,966,884 | A * | 10/1999 | Uglow | 52/302.1 |
| 6,022,054 | A * | 2/2000 | Hemphill et al. | 285/398 |
| 6,097,008 | A * | 8/2000 | Mahin | 219/523 |
| 6,244,006 | B1 * | 6/2001 | Shue et al. | 52/302.1 |
| 6,431,972 | B1 * | 8/2002 | Folsom | 454/18 |
| 6,595,559 | B1 * | 7/2003 | Readman | 285/382 |
| 6,669,552 | B1 * | 12/2003 | Beer | 454/171 |
| 6,935,361 | B2 * | 8/2005 | Rocheleau | 137/340 |
| 7,810,847 | B1 * | 10/2010 | Cornwall | 285/230 |
| 8,091,930 | B2 * | 1/2012 | Robichaux et al. | 285/333 |
| 8,272,186 | B2 * | 9/2012 | Manning | 52/741.4 |
| 8,413,687 | B1 * | 4/2013 | Woodring | 138/27 |
| 8,490,351 | B1 * | 7/2013 | Scott | 52/219 |
| 2002/0032996 | A1 * | 3/2002 | Cornwall | 52/220.8 |
| 2003/0024185 | A1 * | 2/2003 | Menzies | 52/219 |
| 2003/0159398 | A1 * | 8/2003 | Chai | 52/746.11 |
| 2004/0111902 | A1 * | 6/2004 | Fletcher | 33/286 |
| 2004/0123913 | A1 * | 7/2004 | Rocheleau | 138/110 |
| 2005/0005983 | A1 * | 1/2005 | Lewis | 138/41 |
| 2005/0006899 | A1 * | 1/2005 | Lewis | 285/370 |
| 2005/0006900 | A1 * | 1/2005 | Lewis | 285/370 |
| 2006/0249142 | A1 * | 11/2006 | Bibaud et al. | 126/312 |
| 2007/0101689 | A1 * | 5/2007 | Gaskins | 55/385.4 |
| 2008/0271391 | A1 * | 11/2008 | Dalmasso | 52/199 |
| 2010/0178860 | A1 * | 7/2010 | Brunette | 454/44 |
| 2011/0275307 | A1 * | 11/2011 | McIver | 454/367 |
| 2013/0205693 | A1 * | 8/2013 | Scott | 52/198 |
| 2013/0212955 | A1 * | 8/2013 | Lethin | 52/58 |
| 2014/0109492 | A1 * | 4/2014 | Lethin | 52/90.2 |

OTHER PUBLICATIONS

TUBOS® Guide Specification dated Nov. 21, 2010 (6 page).*

TUBOS, Inc. tapered specification, publication date unknown (1 page).*

* cited by examiner 46
50
38
32
36
50
46

46
50
38
32
36
50
46

46
50
38
32
36
50
46

ROOF VENT PIPE EXTENSION SYSTEM

RELATED APPLICATION

The present application is a continuation-in-part application of pending application Ser. No. 12/587,596 filed Oct. 9, 2009, the subject matter of which application is incorporated herein by reference.

BACKGROUND OF THE INVENTION

Field of the Invention

The present invention relates to a roof vent pipe extension assembly and more particularly pertains to extending the length of a vent pipe following the application of a new roof over an old roof, the extending of the length of the vent pipe being done in a code-compliant safe, convenient and economical manner.

SUMMARY OF THE INVENTION

In view of the disadvantages inherent in the known types of vent extension systems of known designs and configurations now present in the prior art, the present invention provides an improved roof vent pipe extension assembly. As such, the general purpose of the present invention, which will be described subsequently in greater detail, is to provide a new and improved roof vent pipe extension assembly and method which has all the advantages of the prior art and none of the disadvantages.

To attain this, the present invention essentially comprises a roof vent pipe extension assembly. First provided is an old roof. The old roof has an upper surface and a lower surface.

A vertical vent pipe is provided. The vertical vent pipe extends through the old roof. The vent pipe has a lower end. The lower end is provided below the old roof. The vent pipe has an upper end. The upper end is a non-code-compliant distance above the old roof. The vent pipe has an interior diameter of 2.75 inches, plus or minus 5 percent. Vent pipes are frequently called vent pipes or vent stacks.

Provided next is a new roof. The new roof has an upper surface and a lower surface. The new roof is applied with its lower surface over and attached to the upper surface of the old roof. The new roof has a circular aperture. The circular aperture has a diameter essentially equal to the diameter of the vent pipe. The vent pipe extends through the aperture of the new roof.

An annular bead is provided. The bead is provided in contact with the upper end of the vent pipe. The bead is fabricated of a non-slump exterior joint sealant, a solvent-free formulated silyl-terminated polyether.

A roof vent pipe extension assembly is provided next. The extension assembly includes a central tube. The central tube has ends. The ends include a first end. The ends further include a second end. The first and second ends are separated by a length of 16 inches plus or minus 5 percent. The central tube has an interior diameter of 2.75 inches plus or minus 5 percent. The central tube has an exterior diameter of 3.25 inches plus or minus 5 percent.

The extension assembly also includes a first end tube. The extension assembly includes a similarly configured second end tube. Each end tube has an inner end. Each end tube has an outer end. The inner and outer ends are separated by a length of 9 inches plus or minus 5 percent. Each end tube has an interior diameter. Each end tube has an exterior diameter of 2.75 inches plus or minus 5 percent. The inner end of each end tube constitutes an unexposed section. The unexposed section is inserted into one of the ends of the central tube for 3 inches plus or minus 5 percent. The unexposed section is secured as by glue into one of the ends of the central tube. In this manner an exposed section of 6 inches plus or minus 5 percent is provided.

The central tube is cut. In this manner two extension components are formed. Each extension component is formed of one of the end tubes and a portion of the central tube. The extension component has a lower end. The lower end of the extension component is inserted into the upper end of the vent pipe. The extension component has an upper end. The upper end of the extension component is spaced above the upper surface of the new roof by a code-compliant distance. The code-compliant distance is greater than the non-code-compliant distance, thereby guaranteeing rainwater is directed down into the plumbing stack accordingly versus into the roof system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roof vent pipe extension assembly which has all of the advantages of the prior art vent extension systems of known designs and configurations and none of the disadvantages.

It is another object of the present invention to provide a new and improved roof vent pipe extension assembly which may be easily and efficiently manufactured and marketed.

It is further object of the present invention to provide a new and improved roof vent pipe extension assembly which is of durable and reliable constructions.

An even further object of the present invention is to provide a new and improved roof vent pipe extension assembly which is susceptible of a low cost of manufacture with regard to both materials and labor, and which accordingly is then susceptible of low prices of sale to the consuming public, thereby making such roof vent pipe extension assembly economically available to the buying public.

Even still another object of the present invention is to provide a roof vent pipe extension assembly for extending the length of a vent pipe following the application of a new roof over an old roof, the extending of the length of the vent pipe being done in a code-compliant safe, convenient and economical manner.

Lastly, it is an object of the present invention to provide a new and improved roof vent pipe extension assembly. An end tube has an interior and exterior diameter and a length. A central tube has an interior and an exterior diameter and a length. The length of the central tube is greater than the length of the end tube. The exterior diameter of the end tube is essentially equal to the interior diameter of the central tube. An upper portion of the end tube is inserted into and secured as by glue to a lower portion of the central tube. In this manner a lower portion of the end tube is adapted to be inserted into a vent pipe of a roof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiment and alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2, 3:
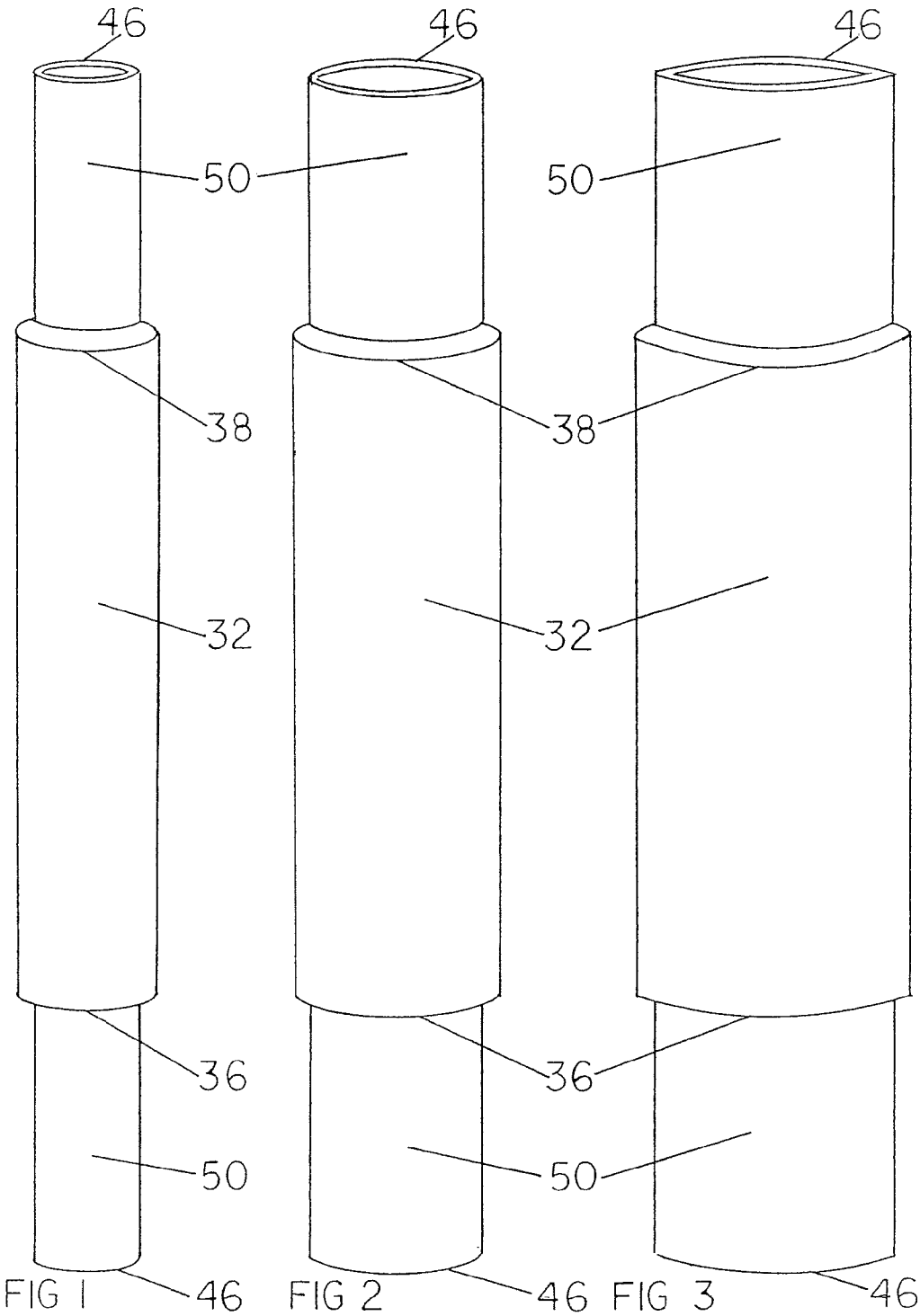
FIGS. 1, 2 and 3 are front elevational views of three roof vent pipe extension systems of various sizes constructed in accordance with the principles of the present invention.
Figure 4:
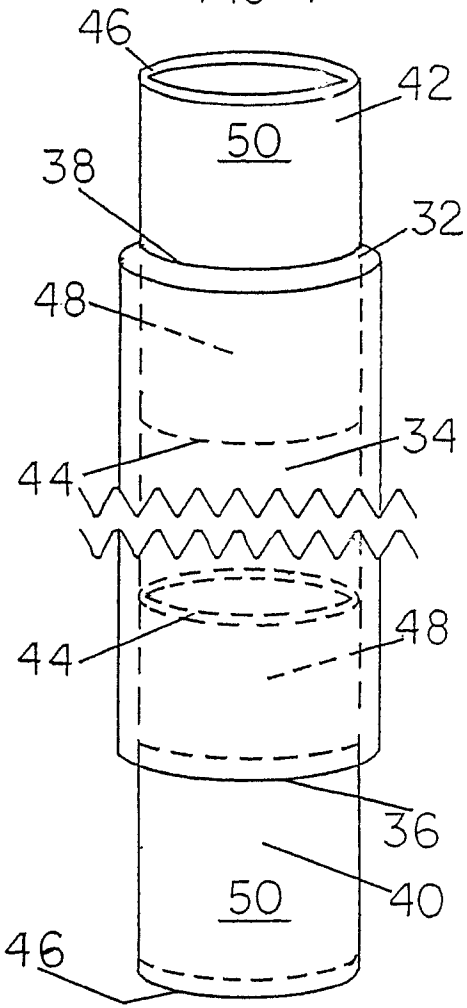
FIG. 4 is a perspective illustration of one of the roof vent pipe extension systems shown in the prior Figures.
Figure 5:
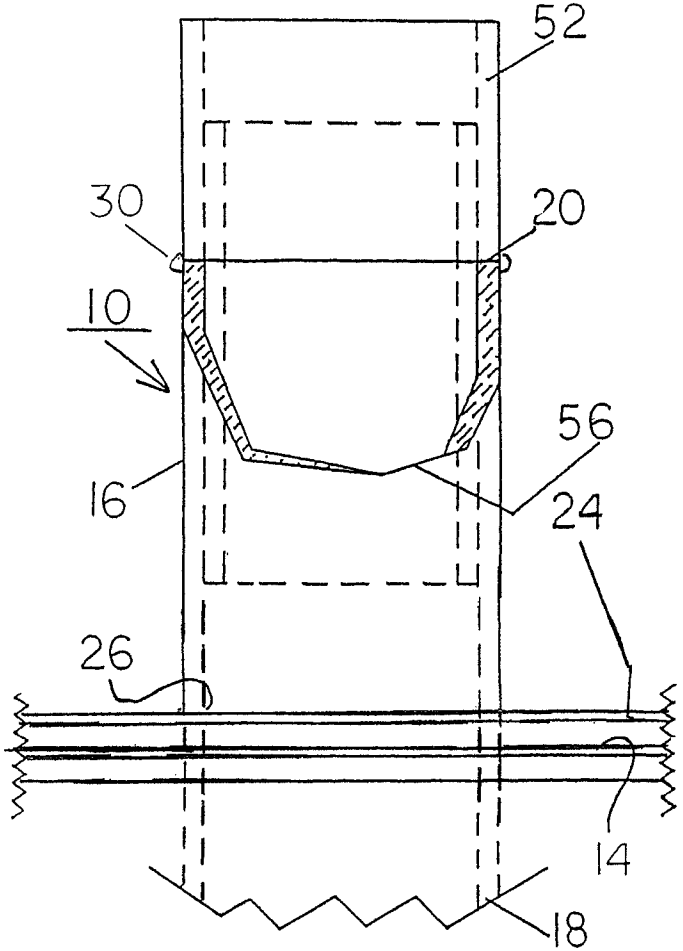
FIG. 5 is a cross sectional view of a roof vent pipe extension systems in a vent pipe of a roof which has received a new roof over an old roof.

With reference now to the drawings, and in particular to FIG. 1 thereof, the preferred embodiment of the new and improved roof vent pipe extension assembly embodying the principles and concepts of the present invention and generally designated by the reference numeral 10 will be described.

The present invention, the roof vent pipe extension assembly 10 is comprised of a plurality of components. Such components in their broadest context include an end tube and a central tube. Such components are individually configured and correlated with respect to each other so as to attain the desired objective.

First provided is an old roof 14. The old roof has an upper surface and a lower surface.

A vertical vent pipe 16 is provided. The vertical vent pipe extends through the old roof. The vent pipe has a lower end 18. The lower end is provided below the old roof. The vent pipe has an upper end 20. The upper end is a non-code-compliant distance above the old roof. The vent pipe has an interior diameter of 2.75 inches, plus or minus 5 percent. Vent pipes are frequently called vent pipes or vent stacks.

Provided next is a new roof 24. The new roof has an upper surface and a lower surface. The new roof is applied with its lower surface over and attached to the upper surface of the old roof. The new roof has a circular aperture 26. The circular aperture has a diameter essentially equal to the diameter of the vent pipe. The vent pipe extends through the aperture of the new roof.

An annular bead 30 is provided. The bead is provided in contact with the upper end of the vent pipe. The bead is fabricated of a non-slump exterior joint sealant, a solvent-free formulated silyl-terminated polyether.

A roof vent pipe extension assembly 32 is provided next. The extension assembly includes a central tube 34. The central tube has ends. The ends include a first end 36. The ends further include a second end 38. The first and second ends are separated by a length of 16 inches plus or minus 5 percent. The central tube has an interior diameter of 2.75 inches plus or minus 5 percent. The central tube has an exterior diameter of 3.25 inches plus or minus 5 percent.

The extension assembly also includes a first end tube 40. The extension assembly includes a similarly configured second end tube 42. Each end tube has an inner end 44. Each end tube has an outer end 46. The inner and outer ends are separated by a length of 8 to 9 inches out with 1 to 3 inches inserted. Each end tube has an interior diameter. Each end tube has an exterior diameter of 2.75 inches plus or minus 5 percent. The inner end of each end tube constitutes an unexposed section 48. The unexposed section is inserted into one of the ends of the central tube for 3 inches plus or minus 5 percent. The unexposed section is secured as by glue into one of the ends of the central tube. In this manner an exposed section 50 of 6 inches plus or minus 5 percent is provided. The central and end tubes are fabricate of polyvinyl chloride.

The central tube is cut. In this manner two extension components 52 are formed. Each extension component is formed of one of the end tubes and a portion of the central tube. The extension component has a lower end. The lower end of the extension component is inserted into the upper end of the vent pipe. The extension component has an upper end. The upper end of the extension component is spaced above the upper surface of the new roof by a code-compliant distance. The code-compliant distance is greater than the non-code-compliant distance.

This arrangement of central and end tubes with an end tube within a vent tube guarantees rainwater is directed down into the tubes or plumbing stack accordingly versus into the roof system. Being the present invention will not leak due to its design, the present invention is the only prefabricated vent extension that is warranted for the life of the roof being installed. A demonstration of the present invention as well as testimonials may be viewed on the internet at www.turbos.biz which is incorporated herein by reference.

An alternate embodiment of the present invention is provided. The vent pipe has a broken upper end 56. The extension assembly of the present invention not only extends old vent pipes but effectively eliminates problems caused by broken vent pipes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof vent pipe extension system for extending a length of a vertical vent pipe following an application of a second roof over a first roof, the system comprising, in combination:

the first roof having an upper surface and a lower surface;

the vertical vent pipe extending through the first roof, the vertical vent pipe having a lower end positioned below the first roof, the vertical vent pipe having an upper end located a first distance above the first roof, the vertical vent pipe having an exterior diameter and an interior diameter;

the second roof having an upper surface and a lower surface, the second roof applied with the lower surface of the second roof over and attached to the upper surface of the first roof, the second roof having a circular aperture with a diameter equal to the exterior diameter of the vertical vent pipe, the vertical vent pipe extending through the circular aperture of the second roof;

an annular bead in contact with the upper end of the vertical vent pipe, the bead being fabricated of a non-slump exterior joint sealant, a solvent-free formulated silyl-terminated polyether;

a roof vent pipe extension assembly, the extension assembly including a central tube having ends being a first end and a second end separated by a length of from 15.2 inches to 16.8 inches, the central tube having an interior diameter and an exterior diameter;

the extension assembly also including a first end tube and a similarly configured second end tube, the first end tube and the second end tube each having an inner end and an outer end separated by a length of 8 inches to 9 inches out of the central tube and 1 inch to 3 inches inserted into the central tube, each end tube having an interior diameter and an exterior diameter, the exterior diameter of each end tube being slidably received in the vertical vent pipe and the central tube, the inner end of each end tube constituting an unexposed section inserted into one of the ends of the central tube and secured by glue therein to provide an exposed section of 5.7 inches and 6.3 inches respectively, whereby when the exposed section of one of the first and second end tubes is inserted into the vertical vent pipe, the central tube will be in contact with the vertical vent pipe with the interior and exterior diameters of the central tube being equal to the interior and exterior diameters of the vertical vent pipe; and the central tube being cut to form two extension components, each extension component being formed of one of the end tubes and a portion of the central tube, the extension component having a lower end inserted into the upper end of the vertical vent pipe, the extension component having an upper end spaced above the upper surface of the second roof by a second distance, the second distance being greater than the first distance.

* * * * *